US010150224B2

(12) United States Patent
Ogawa

(10) Patent No.: US 10,150,224 B2
(45) Date of Patent: Dec. 11, 2018

(54) ELECTRIC HAIR CLIPPER

(71) Applicant: PANASONIC CORPORATION, Osaka (JP)

(72) Inventor: Hitoshi Ogawa, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 187 days.

(21) Appl. No.: 13/944,759

(22) Filed: Jul. 17, 2013

(65) Prior Publication Data

US 2014/0059866 A1 Mar. 6, 2014

(30) Foreign Application Priority Data

Aug. 29, 2012 (JP) ..... 2012-189024

(51) Int. Cl.
*B26B 19/04* (2006.01)
*B26B 19/38* (2006.01)

(52) U.S. Cl.
CPC ..... *B26B 19/04* (2013.01); *B26B 19/3853* (2013.01)

(58) Field of Classification Search
CPC ..... B26B 19/06; B26B 19/04; B26B 19/3853
See application file for complete search history.

(56) References Cited

U.S. PATENT DOCUMENTS 2,207,269 A * 7/1940 Schiff ..... B26B 19/3806 150/161
5,137,065 A * 8/1992 Stewart ..... B27C 7/06 142/1
5,970,616 A * 10/1999 Wahl ..... B26B 19/063 30/199
D513,541 S * 1/2006 Nishizawa ..... D28/49
7,350,300 B2 * 4/2008 Yamaguchi ..... B26B 19/048 30/34.1
2005/0229400 A1 10/2005 Yamaguchi et al.
2006/0021227 A1 * 2/2006 Shiba ..... B26B 19/282 30/43.92
2008/0295340 A1 * 12/2008 Carlucci ..... B26B 19/063 30/199

(Continued)

FOREIGN PATENT DOCUMENTS

EP 0925886 A1 6/1999
JP 2002-066170 A 3/2002

(Continued)

OTHER PUBLICATIONS

Extended European Search Report issued in Application No. 13177558.7 dated Dec. 12, 2013.

*Primary Examiner* — Kenneth E. Peterson
*Assistant Examiner* — Liang Dong
(74) *Attorney, Agent, or Firm* — McDermott Will & Emery LLP

(57) ABSTRACT

An electric hair clipper comprises a main body block and a cutting block. The main body block has a motor built-in. The cutting block is provided with a blade section. The main body block is formed so as to have a configuration that a curved portion is located between an apical end portion and a rear end portion. The apical end portion is set so that an axial direction thereof is inclined with respect to an axial direction of the rear end portion. Further, the cutting block is set so that a cutting edge direction thereof is inclined with respect to the axial direction of the rear end portion.

8 Claims, 6 Drawing Sheets

(56) References Cited

U.S. PATENT DOCUMENTS

| | | | | |
|---|---|---|---|---|
| 2009/0293292 | A1* | 12/2009 | Ramm | B26B 21/522 30/526 |
| 2010/0083508 | A1 | 4/2010 | Cheng | |
| 2011/0167653 | A1* | 7/2011 | Psimadas | B26B 21/222 30/526 |

FOREIGN PATENT DOCUMENTS

| | | | |
|---|---|---|---|
| JP | 2004-016813 | A | 1/2004 |
| JP | 2004-073816 | A | 3/2004 |
| JP | 2004-222742 | A | 8/2004 |
| JP | 1422422 | | 8/2011 |
| JP | 1423082 | | 8/2011 |
| WO | 00/10779 | A1 | 3/2000 |

* cited by examiner

ELECTRIC HAIR CLIPPER

BACKGROUND OF THE INVENTION

Field of the Invention

The invention relates to an electric hair clipper used for removing hairs.

Description of the Related Art

Conventionally, an electric hair clipper is used for removing hairs. The electric hair clipper includes a main body block that is formed into a tubular shape and stores a motor and the like, and a cutting block that is installed at a tip of the main body block. A user slides the cutting block along a skin surface, while holding the main body block with one hand, thereby removing hairs (e.g., see Japanese Patent Application Publication No. 2002-066170).

In the conventional electric hair clipper, generally, the main body block is formed so as to have substantively a linear shape. Therefore, for example, there has been a case where although the usability of the electric hair clipper is well with a certain handgrip, the usability of the electric hair clipper is not well with other handgrips. That is, there has been a case where the usability is not well depending on how to hold the electric hair clipper.

SUMMARY OF THE INVENTION

It is an object of the present invention to provide an electric hair clipper, which can provide a user with good usability even when the user holds the electric hair clipper with various handgrips.

An electric hair clipper of the invention comprises: a main body block formed into a tubular shape, the main body block being held with one hand and having a motor built-in; and a cutting block installed at a tip of the main body block, the cutting block being provided with a comb-shaped blade section that is driven by the motor, and wherein the main body block comprises: an apical end portion at which the cutting block is installed; a rear end portion; and a curved portion located between the apical end portion and the rear end portion, and wherein the rear end portion is positioned on the opposite side of the apical end portion across the curved portion, and wherein the apical end portion is set so that an axial direction thereof is inclined with respect to an axial direction of the rear end portion, the cutting block being set so that a cutting edge direction thereof is inclined with respect to the axial direction of the rear end portion.

In the electric hair clipper, preferably, the curved portion is located at substantively an intermediate region in the entire length ranging from a tip of the cutting block to a rear end of the main body block, the curved portion being provided with a smaller width than each of the apical end portion and the rear end portion in a cutting width direction of the cutting block.

Preferably, the electric hair clipper further comprises a finger rest member, and wherein the finger rest member is located at the curved portion, the finger rest member comprising a series of a first surface section, a second surface section and a third surface section, and wherein the first surface section covers a first surface of an outer periphery of the curved portion, the first surface being a curved inside surface, the second surface section covering a second surface of the outer periphery of the curved portion, the second surface being positioned at one end side in the cutting width direction of the cutting block, the third surface section covering a third surface of the outer periphery of the curved portion, the third surface being positioned at the other end side in the cutting width direction of the cutting block.

Preferably, the electric hair clipper further comprises a switch for operating ON/OFF of the motor, and wherein the switch is located at a curved outside surface of an outer periphery of the curved portion.

In the electric hair clipper, preferably, the motor is stored in the apical end portion and receives electric power supply from a battery stored in the rear end portion.

In the electric hair clipper, preferably, the axial direction of the apical end portion is set so as to be inclined in one direction at an angle that is within the range of 15 degrees to 25 degrees with respect to the axial direction of the rear end portion, and wherein the cutting edge direction of the cutting block is set so as to be inclined in the opposite direction from the one direction at an angle that is within the range of 35 degrees to 45 degrees with respect to the axial direction of the rear end portion extending to the tip side, and wherein when the main body block is viewed from a cutting width direction of the cutting block, the following line is set so as to have a length that is within the range of 60 mm to 80 mm, the line being made by connecting: a start point that is a point at the intersection of a central axis of the apical end portion with an apical surface of the cutting block; and an end point that is a point at the intersection of the central axis of the apical end portion with a central axis of the rear end portion.

In the invention, because the main body block is constituted by the apical end portion, the curved portion and the rear end portion and the apical end portion is set so that the axial direction thereof is inclined with respect to the axial direction of the rear end portion and the cutting block is set so that the cutting edge direction thereof is inclined with respect to the axial direction of the rear end portion, the electric hair clipper has the effect of providing a user with good usability even when the user holds the electric hair clipper with various handgrips.

BRIEF DESCRIPTION OF THE DRAWINGS

Preferred embodiments of the invention will now be described in further details. Other features and advantages of the present invention will become better understood with regard to the following detailed description and accompanying drawings where.

DETAILED DESCRIPTION OF EXEMPLARY EMBODIMENTS

Figure 5:
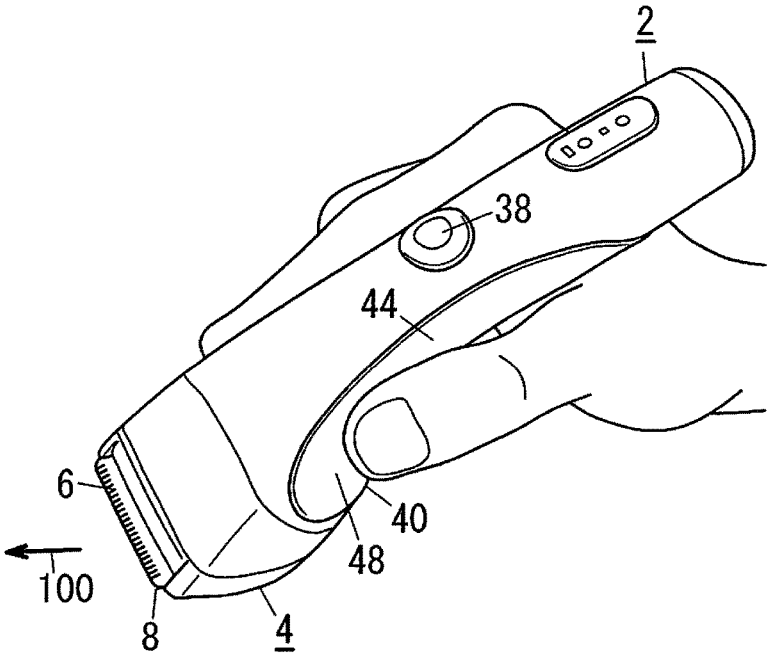
FIG. 5 is a perspective view showing the electric hair clipper when a user is holding the electric hair clipper according to the embodiment of the invention.
Figure 6:
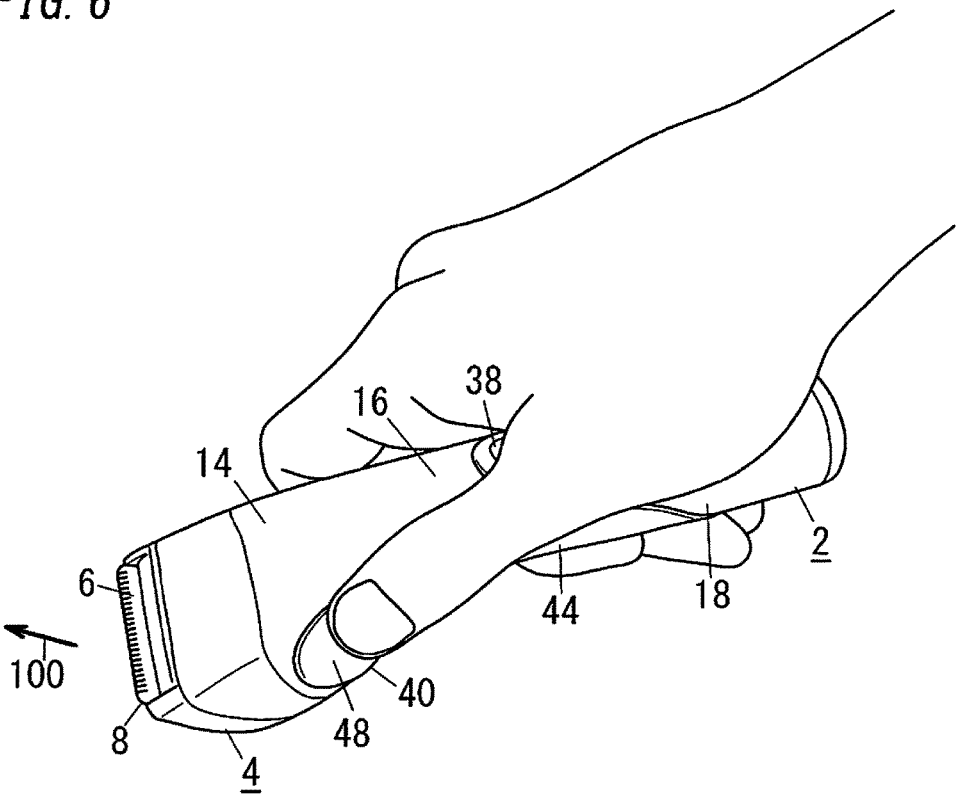
FIG. 6 is a perspective view showing the electric hair clipper when the user is holding the electric hair clipper with another handgrip according to the embodiment of the invention.
Figure 7:
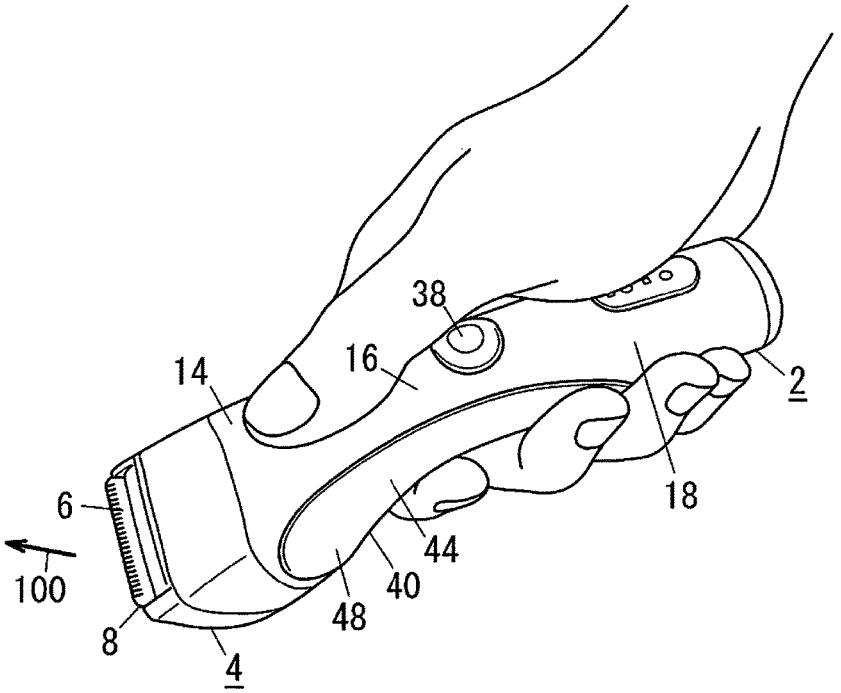
FIG. 7 is a perspective view showing the electric hair clipper when the user is holding the electric hair clipper with yet another handgrip according to the embodiment of the invention.
Figure 8:
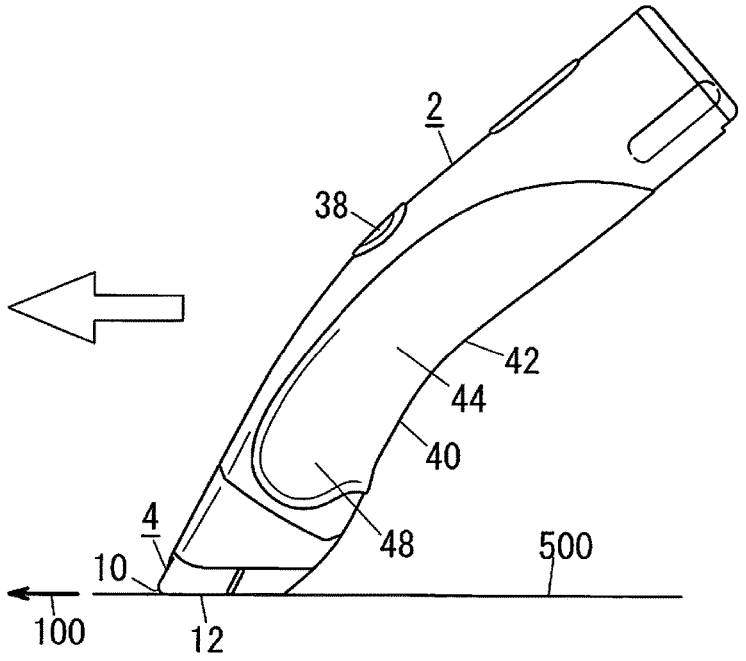
FIG. 8 is a side view showing the electric hair clipper when hair removal is performed using the electric hair clipper according to the embodiment of the invention.

An electric hair clipper according to an embodiment of the invention will be explained below referring to attached Figures. Here, FIGS. 1 to 4 show the electric hair clipper according to one embodiment of the invention, FIGS. 5 to 7 show the user's handgrips for the electric hair clipper, and FIG. 8 shows the appearance of the hair removal performed using the electric hair clipper.

The electric hair clipper of the present embodiment includes a main body block 2 that is formed into a tubular shape so as to be capable of being held with one hand, and a cutting block 4 that is detachably installed at a tip of the axial direction of the main body block 2. The cutting block 4 includes a blade section 10 that is formed by combining a fixed blade 6 with a movable blade 8. Each of the fixed and movable blades 6, 8 has a configuration that a plurality of blades are projected from one end edge thereof, like a comb shape. As a result, the whole of the blade section 10 has a comb shape.

Hereinafter, a projecting direction of the plurality of blades in the blade section 10 is defined as "a cutting edge direction 100", and a direction along which the plurality of blades are arranged like the comb shape is defined as "a cutting width direction 200". The cutting edge direction 100 is perpendicular to the cutting width direction 200. The plurality of blades with the comb shape are called "comb blades". Then, in the blade section 10, the movable blade 8 is reciprocated in the cutting width direction 200 with respect to the cutting block 4, thereby cutting body hair inserted between the comb blades of the fixed blade 6 and the comb blades of the movable blade 8.

In the present embodiment, the blade section 10 is located so as to be in parallel with an apical surface 12 of the cutting block 4. The comb blades of each of the fixed blade 6 and the movable blade 8 that constitute the blade section 10 are projected from an end edge of the apical surface 12 of the cutting block 4, in a direction being in parallel with the apical surface 12. That is, the cutting edge direction 100 is in parallel with the apical surface 12 of the cutting block 4. Here, in the present embodiment, the blade section 10 is formed so that the movable blade 8 is located outside of the fixed blade 6. For this reason, when the electric hair clipper is used as shown in FIG. 8, the movable blade 8 is closer than the fixed blade 6 with respect to a skin surface 500. Therefore, the electric hair clipper can cut the body hair shorter.

The main body block 2 is formed so that a central part in a longitudinal direction thereof is curved in one direction. Specifically, the main body block 2 includes an apical end portion 14 that has substantively a linear shape, a curved portion 16 that has substantively an arc shape, and a rear end portion 18 that has substantively a linear shape. Then, the main body block 2 has a configuration that the adjacent portions of those portions 14, 16 and 18 are formed smoothly and continuously near a point at the intersection of each other's axis directions. The length in the axis direction of the apical end portion 14 is set to be substantively the same as the length in the axis direction of the rear end portion 18. In this case, the axis direction of the apical end portion 14 corresponds to a central axis A1 of the tubular-shaped apical end portion 14. Similarly, the axis direction of the rear end portion 18 corresponds to a central axis A2 of the tubular-shaped rear end portion 18. Then, the curved portion 16 is located between the apical end portion 14 and the rear end portion 18, and therefore, the axis direction of the apical end portion 14 is set so as to be inclined in one direction at an angle θ1 with respect to the axis direction of the rear end portion 18 when viewed from a side.

In this case, the view from the side means viewing the main body block 2 from the cutting width direction 200 of the cutting block 4 installed at the main body block 2. Hereinafter, a surface facing in the cutting width direction 200 of the outer periphery of the main body block 2 is explained as "a lateral surface", and a curved outside surface of the outer periphery of the main body block 2 is explained as "a front surface", and a curved inside surface of the outer periphery of the main body block 2 is explained as "a back surface".

Figure 4:
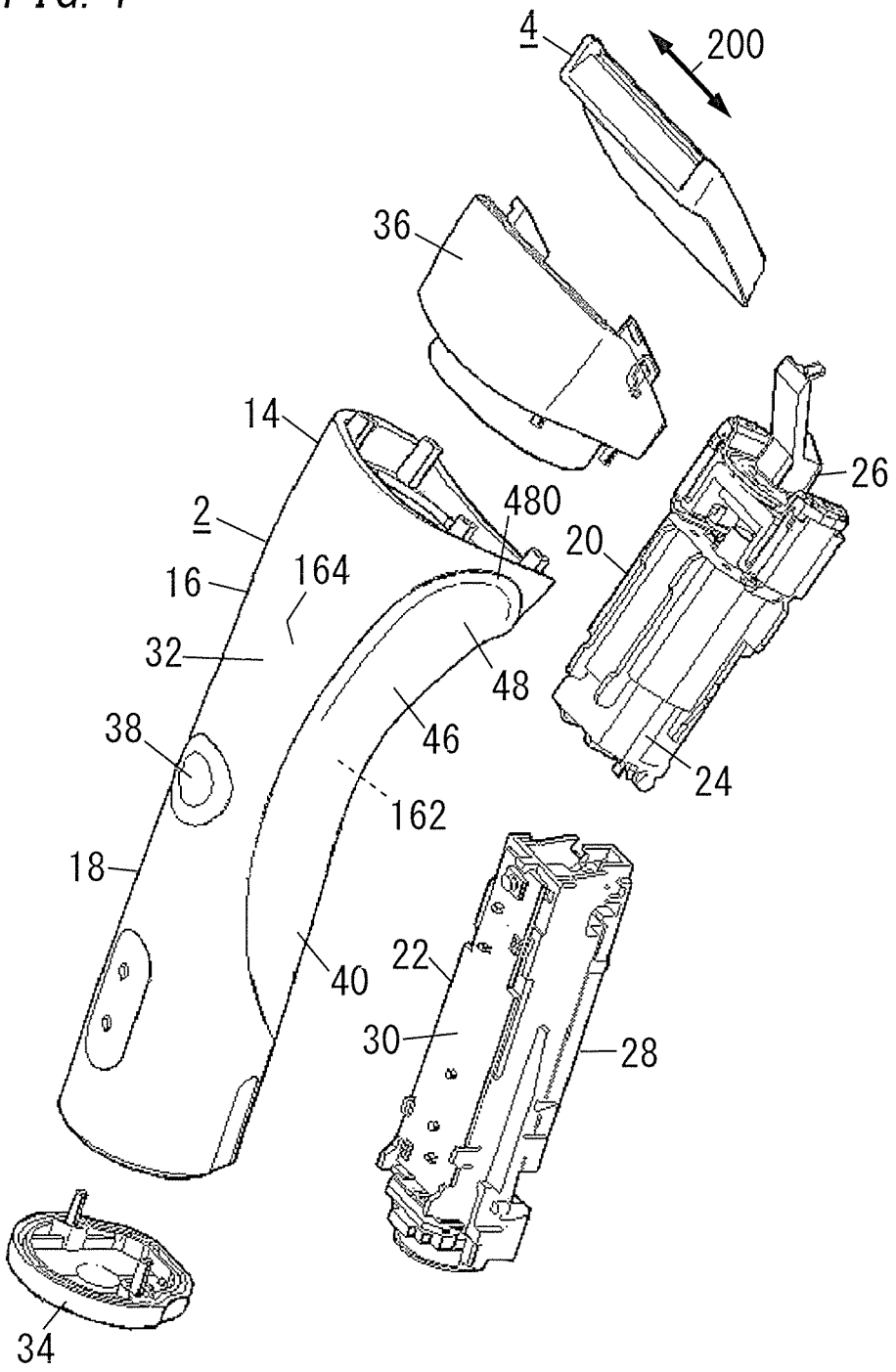
FIG. 4 is an exploded perspective view showing the electric hair clipper according to the embodiment of the invention.

The hollow main body block 2 has a driving generation unit 20 and an electric power supply unit 22 built-in, as shown in FIG. 4. The driving generation unit 20 generates and transfers a driving force in a reciprocating direction for the movable blade 8 of the cutting block 4. The electric power supply unit 22 supplies electric power to the driving generation unit 20. The driving generation unit 20 includes a motor 24 that generates a turning force by receiving the electric power supply, and a transmission mechanism 26 that converts the turning force of the motor 24 into a reciprocating force in the cutting width direction 200 to transfer to the blade section 10. The electric power supply unit 22 includes a battery 28 that is a power source, and a control circuit board 30 that is provided with a control circuit (not shown) configured to control the electric power supplied from the battery 28 to the motor 24.

Because the apical end portion 14 of the main body block 2 has substantively a linear shape, the driving generation unit 20 is located in a hollow portion of the apical end portion 14, by taking advantage of the linear shape. Similarly, because the rear end portion 18 of the main body block 2 has substantively a linear shape, the electric power supply unit 22 is located in a hollow portion of the rear end portion 18, by taking advantage of the linear shape. The driving generation unit 20 and the electric power supply unit 22 located within the main body block 2 are electrically connected to each other through the inside of the curved portion 16 that is positioned at an intermediate region of the main body block 2. That is, for example, when the driving generation unit 20 and the electric power supply unit 22 are electrically connected via a connecting wire (not shown), the connecting wire is located inside of the curved portion 16.

The main body block 2 is provided with a casing that is constituted by a main body casing 32, a rear end cover 34 and a tip frame 36. The main body casing 32 is a main part of the whole of the main body block 2 and is formed into a tubular shape. The rear end cover 34 is installed at a rear end of the main body casing 32. The tip frame 36 is installed at a tip of the main body casing 32. By installing the rear end cover 34 at the main body casing 32, an opened rear end of the main body casing 32 is covered. By installing the tip frame 36 at the main body casing 32, the tip of the main body casing 32 is extended. The cutting block 4 is detachably installed at a tip of the tip frame 36. The attachment and detachment of the cutting block 4 are performed by sliding the cutting block 4 in the cutting edge direction 100 with respect to the tip frame 36.

The electric hair clipper of the present embodiment further includes a switch 38 for operating ON/OFF of the motor 24. The switch 38 is located at a curved outside surface of an outer periphery of the curved portion 16. In other words, the switch 38 is located at the front surface of the curved portion 16 that is positioned at an intermediate region of an outer periphery of the main body block 2. When the switch 38 is pressed, the control circuit mounted on the control circuit board 30 detects the pressing operation, and then controls ON/OFF and the like for the electric power supplied from the battery 28 to the motor 24.

The electric hair clipper of the present embodiment further includes a finger rest member 40. The finger rest member 40 is located at the outer periphery of the main body block 2, and is colored by using colors different from the main body casing 32 and the tip frame 36. The finger rest member 40 can clarify the location at which the user's finger is rested, in response to the user's various handgrips, and is located at an outer periphery of the main body casing 32 of the main body block 2. The finger rest member 40 may be formed of materials different from the main body casing 32 and the tip frame 36.

The finger rest member 40 is located so as to cover at least the curved portion 16 of the main body block 2. In this case, the finger rest member 40 is provided so as not to cover the front surface side of the curved portion 16 where the switch 38 is located. The finger rest member 40 includes a series of a first surface section 42, a second surface section 44 and a third surface section 46. The first surface section 42 covers the back surface (a first surface 161) of the curved portion 16. The second surface section 44 covers one lateral surface (a second surface 162) of the curved portion 16. The third surface section 46 covers the other lateral surface (a third surface 163) of the curved portion 16. That is, the second surface section 44 is extended smoothly from one end edge of the first surface section 42 in the cutting width direction 200, and the third surface section 46 is extended smoothly from the other end edge of the first surface section 42 in the cutting width direction 200.

Each of the second surface section 44 and the third surface section 46 is provided with a finger stop section 48. This finger stop section 48 is formed by increasing the height of the edge 480 of an extended portion that is formed so as to expand in a semicircle toward the tip side when viewed from the lateral surface. That is, the edge 480 of the extended portion is higher than others. The user touches a part surrounded by a periphery of the finger stop section 48 with the tip of the thumb or the forefinger, thereby being capable of positioning of each finger.

Figure 1:
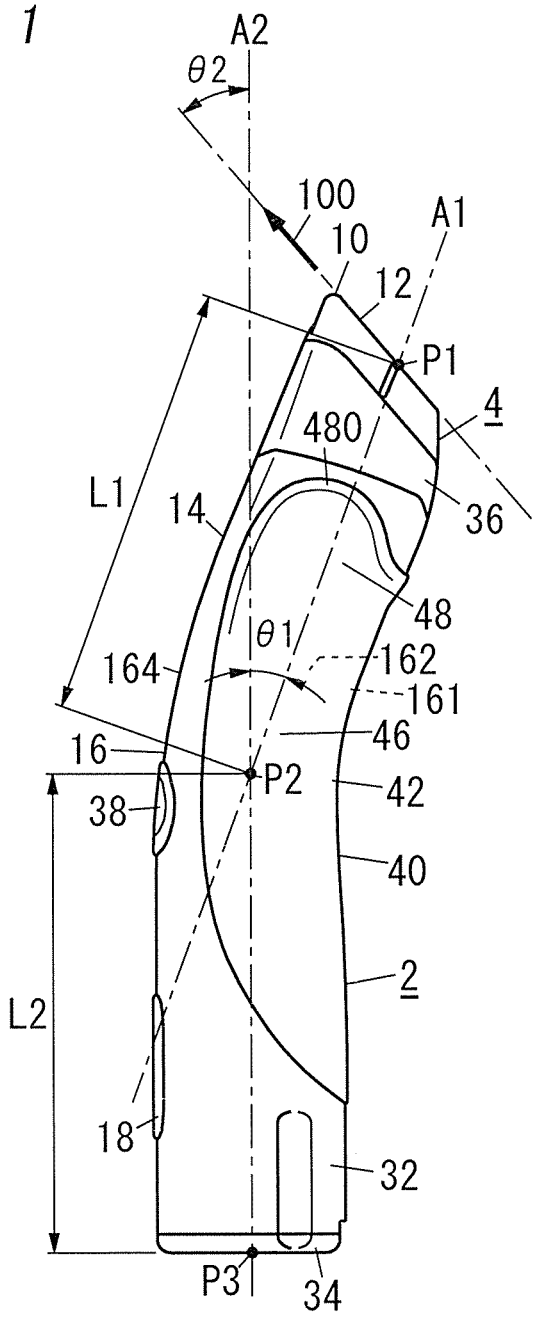
FIG. 1 is a side view showing an electric hair clipper according to an embodiment of the invention.

The electric hair clipper according to the present embodiment has the above-mentioned configuration, and further adopts angular setting and size setting, as shown in FIG. 1, in order to be capable of providing a user with good usability even when the user holds the electric hair clipper with various handgrips.

That is, as mentioned previously, in the main body block 2, the axis direction of the apical end portion 14 is set so as to be inclined in one direction at the angle θ1 with respect to the axis direction of the rear end portion 18 that is positioned on the opposite side of the apical end portion 14 across the curved portion 16, when viewed from the lateral surface. In addition, the cutting edge direction 100 of the cutting block 4 installed at the main body block 2 is set so as to be inclined in the opposite direction from the one direction at an angle θ2 with respect to the axial direction of the rear end portion 18 extending to the tip side, when viewed from the lateral surface. In this case, it is preferred that the angle θ1 is set within the range of 15 degrees to 25 degrees. In the present embodiment, the angle θ1 is set at 20 degrees. It is preferred that the angle θ2 is set within the range of 35 degrees to 45 degrees. In the present embodiment, the angle θ2 is set at 40 degrees.

Further, the entire length ranging from the curved portion 16 to a tip of the cutting block 4 through the apical end portion 14 is substantively equal to the entire length ranging from the curved portion 16 to a rear end of the rear end portion 18. Specifically, when viewed from the lateral surface, it is preferred that a line made by connecting an intersection point (start point) P1 and an intersection point (end point) P2 is set so as to have a length L1 that is within the range of 60 mm to 80 mm. In this case, the intersection point (start point) P1 is a point at the intersection of the central axis A1 of the apical end portion 14 with the apical surface 12 of the cutting block 4. The intersection point (end point) P2 is a point at the intersection of the central axis A1 of the apical end portion 14 with the central axis A2 of the rear end portion 18. In the present embodiment, the length L1 is set at 70.5 mm.

When a point at the intersection of the central axis A2 of the rear end portion 18 with a rear end surface of the rear end portion 18 is denoted by "an intersection point P3", it is preferred that a line made by connecting the intersection point P2 and the intersection point P3 is set so as to have a length L2 that is within the range of 60 mm to 80 mm, similarly. In the present embodiment, the length L2 is set at 78.5 mm. For this reason, the curved portion 16 is located at substantively an intermediate region in the entire length ranging from a tip of the cutting block 4 to a rear end of the main body block 2.

Figure 2:
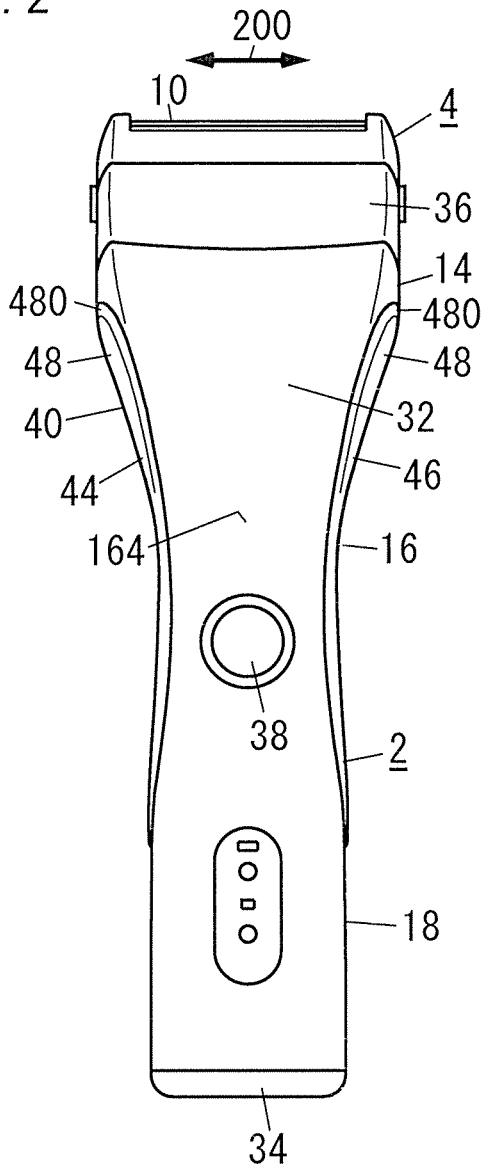
FIG. 2 is a front view showing the electric hair clipper according to the embodiment of the invention.
Figure 3:
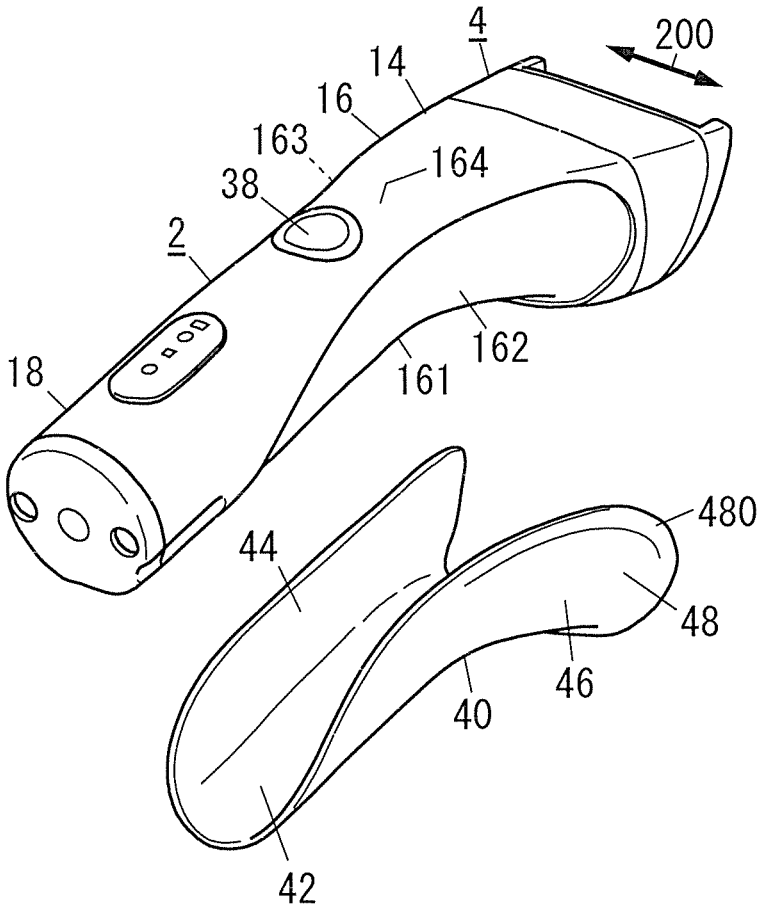
FIG. 3 is a perspective view showing the electric hair clipper in the state where a finger rest member is removed according to the embodiment of the invention.

In regard to the width of the main body block 2 in the cutting width direction 200, the width of the apical end portion 14 is set larger than that of the rear end portion 18 (see FIG. 2). The curved portion 16 is formed so as to be narrowed down smoothly from the lateral surface sides thereof. For this reason, the curved portion 16 is provided with a smaller width than each of the apical end portion 14 and the rear end portion 18.

By adopting the above-mentioned angular setting and size setting, the electric hair clipper according to the present embodiment can provide a user with good usability even when the user holds the electric hair clipper with any one of handgrips shown in FIGS. 5 to 7.

The handgrip shown in FIG. 5 is performed by holding the main body block 2 with one hand so as to hold a pen. In this handgrip, the palm of the user's hand is positioned at the back surface side of the main body block 2, the tip of the user's thumb is pressed against the finger stop section 48 of the second surface section 44 with which the finger rest member 40 is provided, and the tip of the user's forefinger is pressed against the finger stop section 48 of the third surface section 46 with which the finger rest member 40 is provided. Then, the electric hair clipper is used, while the back surface of the main body block 2 is put on a part between the thumb and the forefinger. As shown in FIG. 8, when hair removal is performed, the whole of the electric hair clipper is slid in the cutting edge direction 100 while the apical surface 12 of the cutting block 4 is placed in contact with the skin surface 500. At that time, because a large space is formed between the skin surface 500 and the back surface of the main body block 2 that is curved at the intermediate region in the longitudinal direction of the main body block 2, the large space can prevent the user's hand, with which the main body block 2 is held, from coming into contact with the skin surface 500, as shown in FIG. 5. Therefore, the user can perform hair removal with good usability.

The handgrip shown in FIG. 6 is performed by holding the main body block 2 with the palm of the user's hand while pressing the user's thumb and forefinger against the lateral surfaces of the main body block 2, respectively. In this handgrip, the palm of the user's hand is positioned at the front surface side of the main body block 2, the tip of the user's thumb is pressed against the finger stop section 48 of the second surface section 44 with which the finger rest member 40 is provided, and the side of the user's forefinger is pressed against the finger stop section 48 of the third surface section 46 with which the finger rest member 40 is provided. Then, the remaining three fingers are placed at the back surface side of the rear end portion 18 of the main body block 2, thereby holding the whole of the electric hair clipper. As shown in FIG. 8, when hair removal is performed, the whole of the electric hair clipper is slid in the cutting edge direction 100 while the apical surface 12 of the cutting block 4 is placed in contact with the skin surface 500. At that time, the electric hair clipper is used in the following posture of the main body block 2: the axis direction of the apical end portion 14 is inclined to the side of the opposite direction from the cutting edge direction 100 with respect to a direction perpendicular to the skin surface 500 (that is, the apical surface 12 of the cutting block 4), and the axis direction of the rear end portion 18 is inclined to the side of the opposite direction from the cutting edge direction 100 at an angle larger than the axis direction of the apical end portion 14. Therefore, even when the user holds the electric hair clipper while touching the rear end portion 18 with the remaining three fingers and the palm of the hand, the electric hair clipper can prevent the user's elbow from being held too high, and can provide the user with good usability.

The handgrip shown in FIG. 7 is performed by holding the main body block 2 with the whole of the palm of the user's hand while pressing the user's thumb against the front surface of the main body block 2. In this handgrip, the palm of the user's hand is positioned at one lateral surface with respect to the main body block 2, the user's thumb is pressed against the front surface of the apical end portion 14 of the main body block 2, and the remaining four fingers are pressed against the back surface side of the rear end portion 18 of the main body block 2, thereby holding the electric hair clipper. As shown in FIG. 8, when hair removal is performed, the whole of the electric hair clipper is slid in the cutting edge direction 100 while the apical surface 12 of the cutting block 4 is placed in contact with the skin surface 500. At that time, because a large space is formed between the skin surface 500 and the back surface of the main body block 2 that is curved at the intermediate region in the longitudinal direction of the main body block 2, the large space can prevent the user's hand, with which the main body block 2 is held, from coming into contact with the skin surface 500. Further, the axis direction of the rear end portion 18 is inclined to the side of the opposite direction from the cutting edge direction 100 at an angle larger than the axis direction of the apical end portion 14. Therefore, even when the user holds the electric hair clipper while touching the rear end portion 18 with the four fingers and the palm of the hand, the electric hair clipper can prevent the user's elbow from being held too high, and can provide the user with good usability.

As explained above referring to the attached Figures, the electric hair clipper according to the present embodiment includes the main body block 2 that is formed into a tubular shape and is held with one hand, and the cutting block 4 that is installed at a tip of the main body block 2. The main body block 2 has the motor 24 built-in. The cutting block 4 is provided with the comb-shaped blade section 10 that is driven by the motor 24. The main body block 2 includes the apical end portion 14 at which the cutting block 4 is installed, the rear end portion 18, and the curved portion 16 that is located between the apical end portion 14 and the rear end portion 18. The rear end portion 18 is positioned on the opposite side of the apical end portion 14 across the curved portion 16. The apical end portion 14 is set so that an axial direction thereof is inclined with respect to an axial direction of the rear end portion 18, and the cutting block 4 is set so that the cutting edge direction 100 thereof is inclined with respect to the axial direction of the rear end portion 18.

In this way, the electric hair clipper of the present embodiment has a configuration that the whole of the main body block 2 is curved through the curved portion 16. Therefore, the user can hold the main body block 2 with various handgrips, and can perform the hair removal with good usability.

In the electric hair clipper of the present embodiment, the curved portion 16 is located at substantively an intermediate region in the entire length ranging from a tip of the cutting block 4 to a rear end of the main body block 2, and the curved portion 16 is provided with a smaller width than each of the apical end portion 14 and the rear end portion 18 in the cutting width direction 200 of the cutting block 4.

In this way, even when holding the main body block 2 from the back surface side so as to hold a pen for example, the user can easily hold the main body block 2 by touching the main body block 2 with the fingers, utilizing the curved portion 16, and the electric hair clipper can prevent the user's hand, with which the main body block 2 is held, from coming into contact with the skin surface 500. Then, even when the user holds the rear end portion 18 of the main body block 2 with the palm of the hand for example, the electric hair clipper is used in the posture that the rear end portion 18 is further inclined with respect to the apical end portion 14. Therefore, the electric hair clipper can prevent the user's elbow from being held too high, and can provide the user with good usability.

Further, the electric hair clipper includes the finger rest member 40. The finger rest member 40 is located at the curved portion 16. The finger rest member 40 includes a series of the first surface section 42, the second surface section 44 and the third surface section 46. The first surface section 42 covers a first surface 161 of an outer periphery of the curved portion 16. The first surface 161 is a curved inside surface. The second surface section 44 covers a second surface 162 of the outer periphery of the curved portion 16. The second surface 162 is positioned at one end side in the cutting width direction 200 of the cutting block 4. The third surface section 46 covers a third surface 163 of the outer periphery of the curved portion 16. The third surface 163 is positioned at the other end side in the cutting width direction 200 of the cutting block 4.

In this way, the positions where the fingers are placed can be made clear, when the user holds the main body block 2. Further, the movement of the fingers placed on the finger rest member 40 can be also prevented. As a result, the electric hair clipper can provide the user with better usability.

Further, the electric hair clipper includes the switch 38 for operating ON/OFF of the motor 24, and the switch 38 is located at a curved outside surface (a fourth surface 164) of an outer periphery of the curved portion 16.

In this way, even while holding the main body block 2, the user can easily perform the ON/OFF operation of the motor 24 by placing the finger on the switch 38. When holding the main body block 2 from the back surface side so as to hold a pen for example, the user can easily operate the switch 38 by directly sliding the tip of the thumb toward the front surface side of the main body block 2.

Further, the motor 24 is stored in the apical end portion 14, and receives electric power supply from the battery 28 that is stored in the rear end portion 18.

In this way, the motor 24 and the battery 28 are respectively stored in the portions except the curved portion, with respect to the main body block 2 curved at the middle thereof. Therefore, the internal space of the main body block 2 can be effectively utilized.

Further, in the electric hair clipper of the present embodiment, the axial direction of the apical end portion 14 is set so as to be inclined in one direction at an angle that is within the range of 15 degrees to 25 degrees with respect to the axial direction of the rear end portion 18. The cutting edge direction 100 of the cutting block 4 is set so as to be inclined in the opposite direction from the one direction at an angle that is within the range of 35 degrees to 45 degrees with respect to the axial direction of the rear end portion 18 extending to the tip side. When the main body block 2 is viewed from the cutting width direction 200 of the cutting block 4, the following line is set so as to have a length L1 that is within the range of 60 mm to 80 mm. The line is made by connecting: a start point that is the point P1 at the intersection of the central axis A1 of the apical end portion 14 with the apical surface 12 of the cutting block 4; and an end point that is the point P2 at the intersection of the central axis A1 of the apical end portion 14 with the central axis A2 of the rear end portion 18. In order to provide the user with good usability as explained above, those settings are preferable.

Although the present invention has been described with reference to certain preferred embodiments, numerous modifications and variations can be made by those skilled in the art without departing from the true spirit and scope of this invention, namely claims.

The invention claimed is:

1. An electric hair clipper, comprising:

a main body block formed into a tubular shape, the main body block being held with one hand and having a motor built-in;

a cutting block installed at a tip of the main body block, the cutting block being provided with a comb-shaped blade section that is driven by the motor; and a switch for operating ON/OFF of the motor, wherein the main body block comprises:

an apical end portion at which the cutting block is installed;

a rear end portion having a central axis;

a curved portion located between the apical end portion and the rear end portion; and a finger rest member, wherein the rear end portion is positioned on an opposite side of the apical end portion across the curved portion, wherein the apical end portion is set so that an axial direction thereof is inclined with respect to an axial direction of the rear end portion, the cutting block being set so that a cutting edge direction thereof is inclined with respect to the axial direction of the rear end portion, wherein an outer periphery of the curved portion comprises:

a first surface that is an inside surface curved so as to be recessed so as to have an arc shape, the first surface having a concave portion;

a second surface that is positioned at one end side in a cutting width direction of the cutting block;

a third surface that is positioned at another end side in the cutting width direction of the cutting block; and a fourth surface that is a curved outside surface where the switch is located, wherein the second surface and the third surface are curved so as to be recessed toward the central axis such that the curved portion is provided with a smaller width than each of the apical end portion and the rear end portion in the cutting width direction of the cutting block;

wherein the finger rest member is located at the curved portion so as not to cover the fourth surface, the finger rest member is formed by only a series of a first surface section, a second surface section and a third surface section, the first surface section, and the second surface section and the third surface section are contiguous, wherein the first surface section covers the first surface, the second surface section covering the second surface, the second surface section extending over the central axis of the rear end portion, the third surface section covering the third surface, and the third surface section extending over the central axis of the rear end portion, wherein the finger rest member comprises a finger stop section corresponding to an extended portion, that extends in a semicircle, from each of the second surface section and the third surface section toward the tip of the main body block, wherein the finger stop section has an edge which is higher than an adjacent section such that a finger can perceive contacting the edge, wherein the edge is only provided at a periphery of the finger rest member, and wherein the finger stop section is flared outwards and devoid of switches, so as to improve a finger grip at each of the finger stop section.

2. The electric hair clipper according to claim 1, wherein the curved portion is located at substantially an intermediate region in an entire length ranging from a tip of the cutting block to a rear end of the main body block.

3. The electric hair clipper according to claim 1, wherein the motor is stored in the apical end portion and receives electric power supply from a battery stored in the rear end portion.

4. The electric hair clipper according to claim 1, wherein the axial direction of the apical end portion is set so as to be inclined in one direction at an angle that is within a range of 15 degrees to 25 degrees with respect to the axial direction of the rear end portion, wherein the cutting edge direction of the cutting block is set so as to be inclined in an opposite direction from the one direction at an angle that is within a range of 35 degrees to 45 degrees with respect to the axial direction of the rear end portion extending to a side of the tip, and wherein when the main body block is viewed from a cutting width direction of the cutting block, a following line is set so as to have a length that is within a range of 60 mm to 80 mm, the line being made by connecting: a start point that is a point at an intersection of a central axis of the apical end portion with an apical surface of the cutting block; and an end point that is a point at an intersection of the central axis of the apical end portion with a central axis of the rear end portion.

5. The electric hair clipper according to claim 1, wherein the first surface section extends in the longitudinal direction of the first surface and covers the concave portion of the first surface.

6. The electric hair clipper according to claim 1, wherein the finger stop section is formed so as to expand in a semicircle toward the tip of the main body block when viewed from a lateral side of the main body block.

7. The electric hair clipper according to claim 6, wherein the finger stop section is closer to the cutting block than the switch.

8. The electric hair clipper according to claim 1, wherein the finger stop section is closer to the cutting block than the switch.

* * * * *